US006792647B2

(12) United States Patent
Park et al.

(10) Patent No.: US 6,792,647 B2
(45) Date of Patent: Sep. 21, 2004

(54) FILTER SUPPORTING STRUCTURE FOR AN UPRIGHT-TYPE VACUUM CLEANER

(75) Inventors: Jung-seon Park, Gwangju (KR); Il-won Yang, Gwangju (KR); Hyung-il Jeon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 360 days.

(21) Appl. No.: 10/140,458

(22) Filed: May 7, 2002

(65) Prior Publication Data

US 2003/0140446 A1 Jul. 31, 2003

(30) Foreign Application Priority Data

Jan. 30, 2002 (KR) ..... 2002-5301

(51) Int. Cl.[7] ..... A47L 9/12; A47L 9/14

(52) U.S. Cl. ..... 15/351; 15/347; 55/495; 55/DIG. 3

(58) Field of Search ..... 15/347, 351, 352; 55/494, 495, 501, DIG. 2, DIG. 3

(56) References Cited

U.S. PATENT DOCUMENTS 3,651,536 A * 3/1972 Bolzan et al. ..... 15/323
3,668,842 A * 6/1972 Batson et al. ..... 55/417
6,035,486 A * 3/2000 McCormick ..... 15/352

FOREIGN PATENT DOCUMENTS

| | | |
|---|---|---|
| DE | 4430620 | 8/1994 |
| DE | 19754149 | 6/1998 |
| DE | 29813718 | 11/1998 |
| EP | 0391338 | 1/1993 |
| FR | 2746289 | 9/1997 |
| JP | 2002-136458 * | 5/2002 |

* cited by examiner

*Primary Examiner*—Terrence R. Till
(74) *Attorney, Agent, or Firm*—Ladas & Parry

(57) ABSTRACT

A filter supporting structure for an upright-type vacuum cleaner having a body divided by a partition into a dust-collecting chamber having a dust bag and a motor driving chamber, a filter grill formed at the partition in order to allow an air passed through the dust bag of the dust-collecting chamber to flow to the motor driving chamber, and having a filter for filtering the drawn air, supporting protrusions disposed at both sidewalls of the dust-collecting chamber in order to support both sides of the filter mounted on the filter grill, and a plurality of ribs disposed around the filter grill in order to support the filter.

5 Claims, 4 Drawing Sheets

FILTER SUPPORTING STRUCTURE FOR AN UPRIGHT-TYPE VACUUM CLEANER

BACKGROUND OF THE INVENTION

1. Field of the Invention

The present invention relates generally to an upright-type vacuum cleaner, and more particularly, to a filter supporting structure for an upright-type vacuum cleaner.

2. Description of the Prior Art

A conventional upright-type vacuum cleaner cleans a surface to be cleaned, such as a floor or a carpet, by drawing dust and dirt entertained in air that is drawn from the outside by using a suction force generated inside of the cleaner body. As shown in FIG. 1, the conventional upright-type vacuum cleaner has a suction brush 1, a body 2 rotatably connected with the suction brush 1, and a handle 3 disposed at an upper part of the body 2 in order to allow a user to move the suction brush 1. The body 2 is divided by a partition defining a dust-collecting chamber having a dust bag and a motor driving chamber having a motor. The dust-collecting chamber is closed by a dust cover 4. In addition, at a side of the body 2, there is a discharging grill 5 in fluid communication with the motor driving chamber.

A filter grill is formed at the partition in order to allow the air in the dust-collecting chamber to flow into the motor driving chamber. A filter for filtering the drawn air is installed in the filter grill. Vacuum cleaners apply various filter supporting structures into which the filter is installed.

FIG. 2 is an exploded perspective view schematically showing in detail a part of an upright-type vacuum cleaner applying a conventional filter supporting structure. As shown in FIG. 2, the conventional filter supporting structure includes the filter grill 31 formed at the partition 30 that divides the inside of the body 2 between the dust-collecting chamber 10 and the motor driving chamber 20, a pair of supporting ribs 32, one of which is shown in FIG. 2, disposed at both side-walls of the dust-collecting chamber 10 above the filter grill 31, and a filter guard 50 embracing a filter 40 and installed on the filter grill 31 by being supported by the supporting ribs 32. The filter guard 50 has a grid pattern including a plurality of holes.

According to the above filter supporting structure, the filter guard 50 embracing the filter 40 is installed on the filter grill 31 as a user pushes the filter guard 50 between the filter grill 31 and the supporting ribs 32 after installing the filter 40 in the filter guard 50.

However, the conventional filter supporting structure needs a separate filter guard 50 to settle the filter 40 at the supporting ribs 32, thus the production cost of the vacuum cleaner increases and the changing of the filter 40 becomes inconvenient to the user. Moreover, as the filter guard 50 has a grid pattern, the flow of the air passing through the filter 40 can be inhibited.

Furthermore, in the above conventional filter supporting structure, the supporting ribs 32 have a sharp edge, thus the dust bag can be torn by contact with the sharp edge.

SUMMARY OF THE INVENTION

An object of the present invention is to provide a filter supporting structure for an upright-type vacuum cleaner that allows for the filter to be easily changed and reduces the production cost of the vacuum cleaner by removing the filter guard.

The above object is accomplished by providing a filter supporting structure for an upright-type vacuum cleaner according to the present invention having: a body divided by a partition into a dust-collecting chamber having a dust bag and a motor driving chamber; a filter grill formed at the partition in order to allow air to pass through the dust bag of the dust-collecting chamber and into the motor driving chamber, having a filter mounted thereon; supporting protrusions disposed at both sidewalls of the dust-collecting chamber in order to support both sides of the filter mounted on the filter grill; and a plurality of ribs disposed around the filter grill in order to support an upper side and a lower side of the filter.

Accordingly, the filter can be installed on the filter grill without the use of a separate filter guard. Therefore, the number of required elements is reduced and the filter can be easily changed.

BRIEF DESCRIPTION OF THE DRAWINGS

The object and features of the present invention will be more apparent by describing the preferred embodiment of the present invention by referring to the appended drawings, in which.

DETAILED DESCRIPTION OF THE PREFERRED EMBODIMENT

Figure 1:
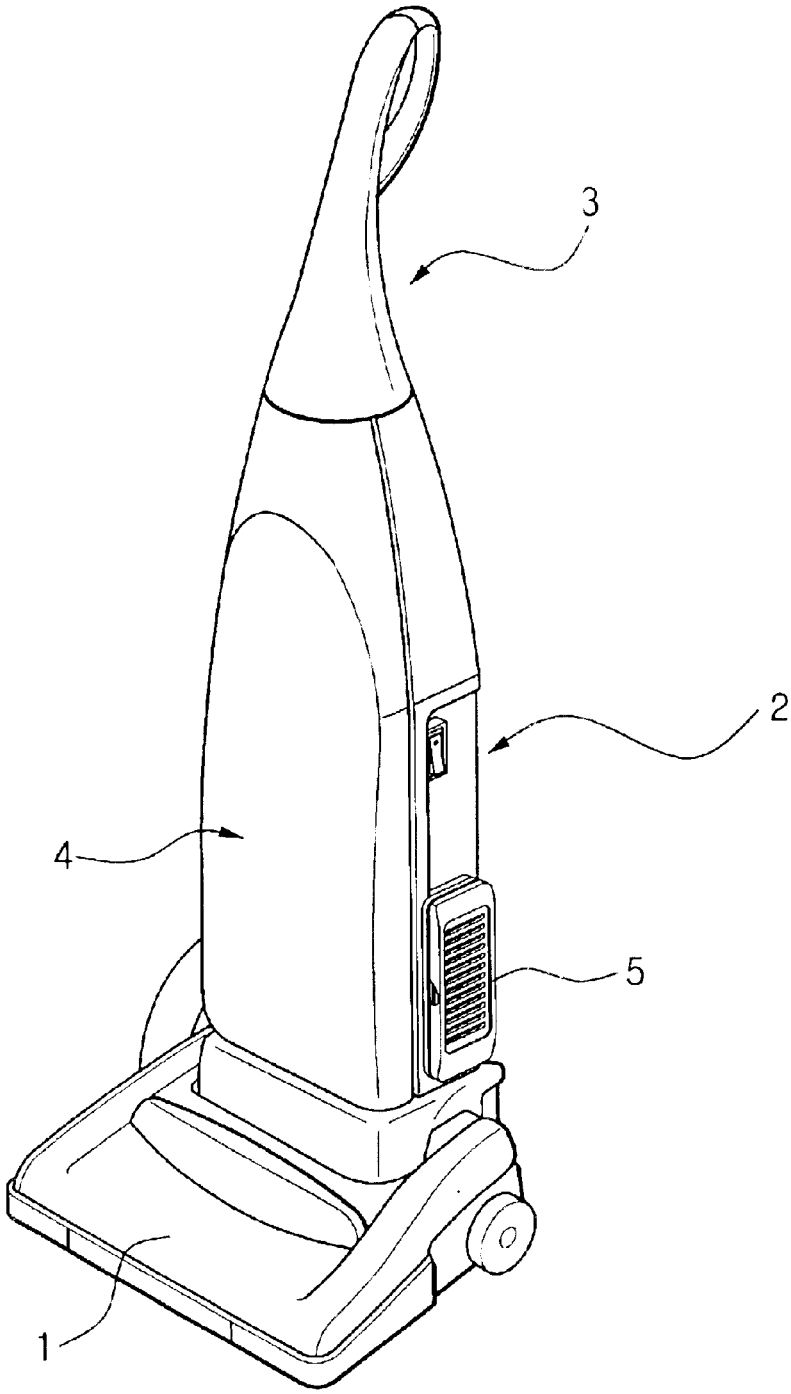
FIG. 1 (PRIOR ART)
FIG. 1 is a perspective view schematically showing a conventional upright-type vacuum cleaner.
Figure 2:
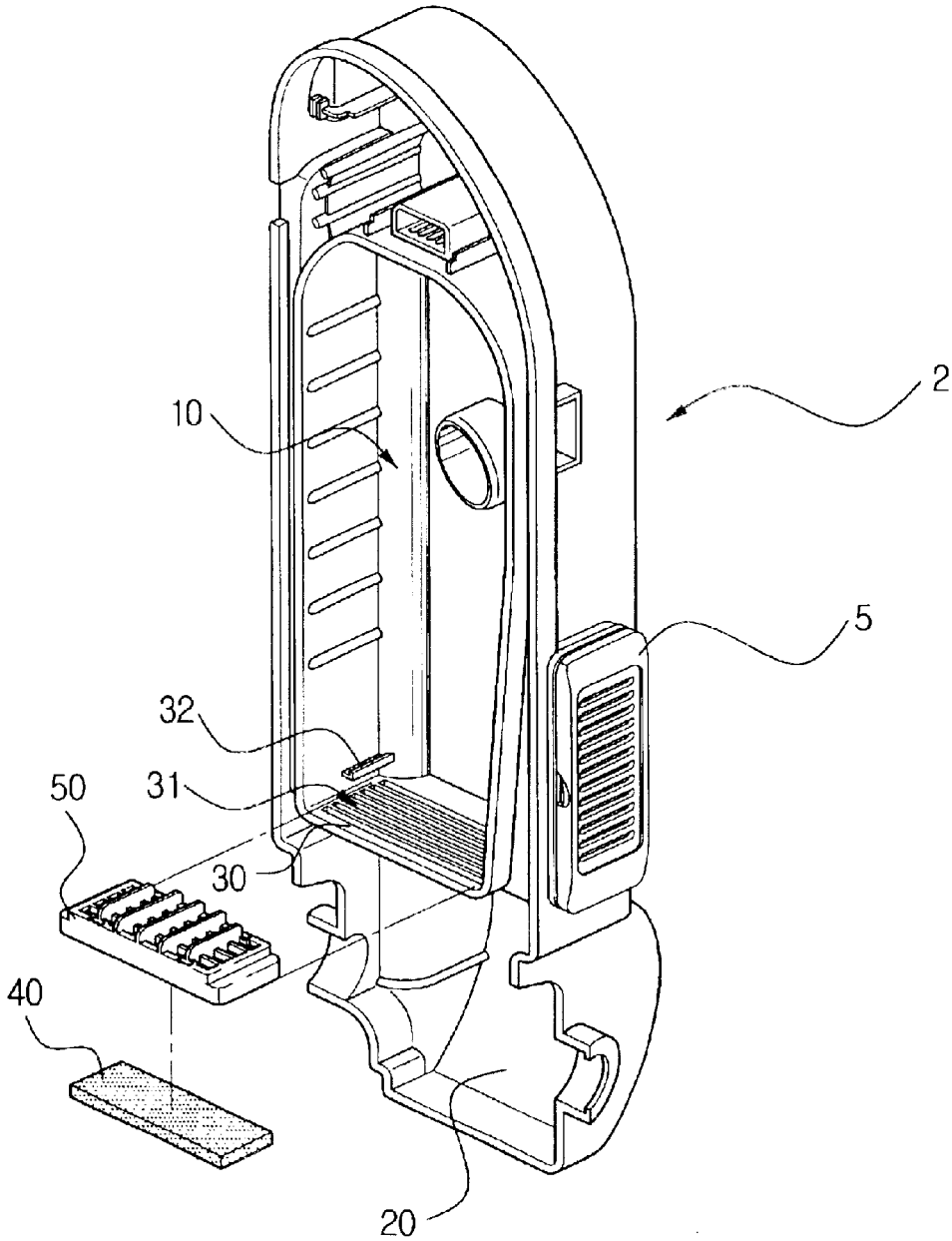
FIG.2 (PRIOR ART)
FIG. 2 is an exploded perspective view schematically showing in detail a part of an upright-type vacuum cleaner applying a conventional filter supporting structure.
Figure 3:
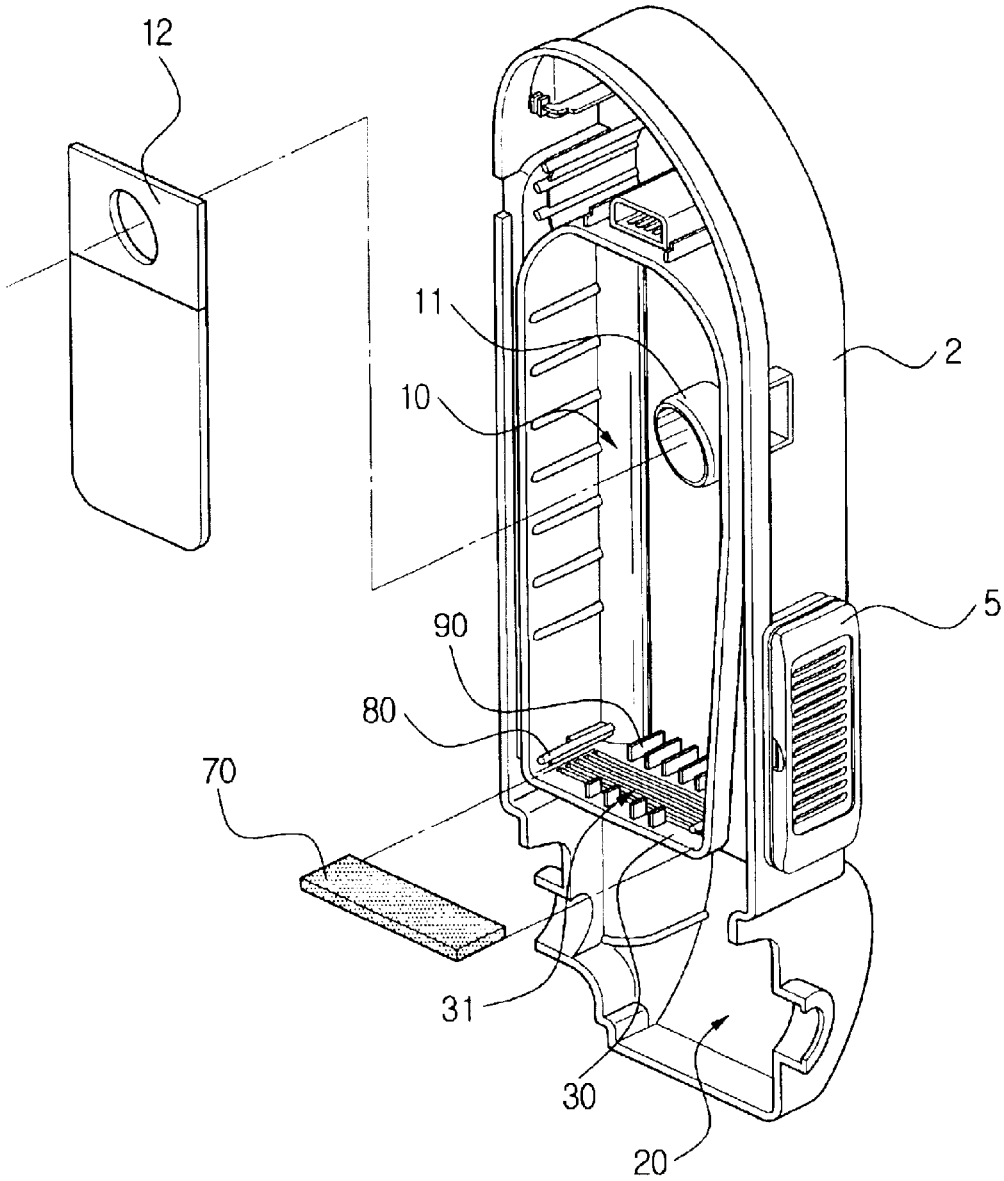
FIG. 3 is an exploded perspective view schematically showing in detail a part of an upright-type vacuum cleaner applying a filter supporting structure according to the present invention.
Figure 4:
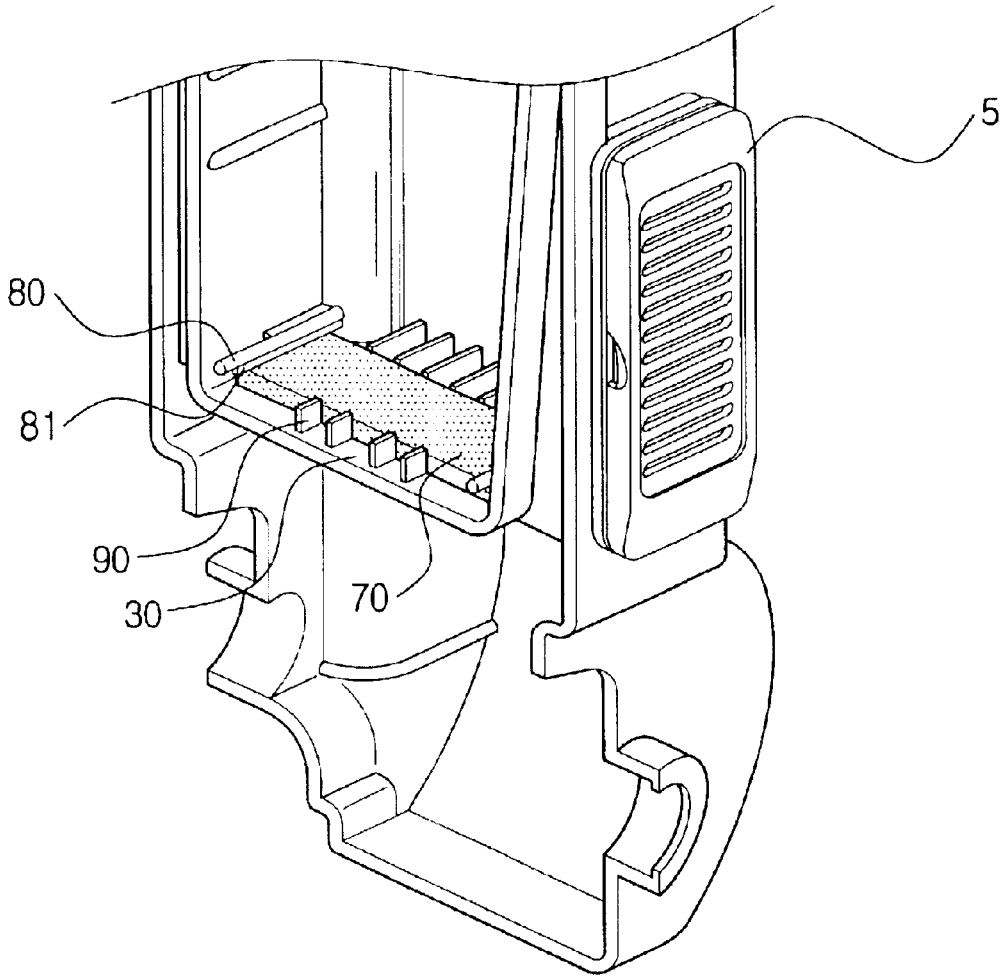
FIG. 4 is a partial perspective view of FIG. 3, further showing in greater detail the filter supporting structure according to the present invention.

The preferred embodiment of the present invention is further described in greater detail by referring to the appended drawing FIGS. 3 and 4, in which like elements as those shown in the conventional vacuum cleaner of FIGS. 1 and 2 will be indicated by identical reference numerals.

As shown in FIGS. 3 and 4, a filter supporting structure of an upright-type vacuum cleaner according to the present invention includes a body 2 divided into a dust-collecting chamber 10 and a motor driving chamber 20 by a partition 30, a filter grill 31 embracing a filter 70, a pair of supporting protrusions 80 and a plurality of upstanding ribs 90.

An air suction port 11 communicating with a suction brush 1 (FIG. 1) is formed in the dust-collecting chamber 10, and a dust bag 12 is installed over the air suction port 11. A motor (not shown) to generate a suction force is installed in the motor driving chamber 20. In addition, a discharging grill 5 is installed at a side of the body 2 to communicate with the motor driving chamber 20.

The filter grill 31 is formed within the partition 30. The air in the dust-collecting chamber 10 is drawn into the motor driving chamber 20 through the filter grill 31. The filter 70 is settled at the filter grill 31 to filter the air drawn from the dust-collecting chamber 10 to the motor driving chamber 20.

The supporting protrusions 80 are disposed at both sidewalls of the dust-collecting chamber 10 in order to support the filter 70 being mounted on the filter grill 31. The supporting protrusions 80 have a curved side contacting with the dust bag 12 to prevent the dust bag 12 from being torn by a contact with the supporting protrusions 80 as the dust bag 12 expands. More preferably, the supporting protrusions 80 are formed in a cylindrical shape so that the supporting protrusions 80 do not hinder the flow of the air in the dust-collecting chamber 10. Furthermore, pressing members 81 may be formed at a lower part of the supporting protrusions to firmly support the filter 70 against the filter grill 31.

The ribs 90 are disposed around the filter grill 31 at a regular interval. The ribs 90 support an upper side and a lower side of the filter 70 in order to prevent the filter 70 mounted on the filter grill 31 from being moved. The ribs 90 are formed to extend higher than and above the width of the filter 70 in order to prevent the dust bag 12 from coming into contact with the filter 70. In other words, when the dust bag 12 expands as the motor drives, an area is formed by the ribs 90 for the air to flow between the dust bag 12 and the filter 70. Accordingly, the flow of air from the dust-collecting chamber 10 to the motor driving chamber 20 is not stopped, and the motor is prevented from being overloaded.

For the filter supporting structure according to the present invention described so far, the user can dust or clean the filter 70 after separating the filter 70 from the filter grill 31 of the dust-collecting chamber 10. On the other hand, the user can easily change the filter 70 by simply inserting a new filter between the filter grill 31 and the supporting protrusions 80 after the old filter is removed.

According to the present invention having the above structure, the filter 70 is simply supported by the supporting protrusions 80 disposed at the sidewalls of the dust-collecting chamber 10 and the ribs 90 disposed around the filter grill 31, thus a filter supporting structure can be manufactured with a reduced number of elements. In addition, the filter supporting structure does not hinder the flow of the air. Therefore, according to the present invention, the production cost for the vacuum cleaner is also decreased.

Furthermore, since the upper side of the supporting protrusions 80 are curved, the dust bag 12 is not easily torn when the dust bag 12 expands against the supporting protrusions 80.

So far, the preferred embodiment of the present invention has been illustrated and described. However, the present invention is not limited to the preferred embodiment described here, and someone skilled in the art can modify the present invention without distorting the point of the present invention as claimed.

What is claimed is:

1. A filter supporting structure for an upright-type vacuum cleaner comprising:

a body divided by a partition into a dust-collecting chamber having a dust bag and a motor driving chamber;

a filter grill formed at the partition in order to allow air to pass through the dust bag of the dust-collecting chamber to the motor driving chamber, the filter grill embracing a filter for filtering the air;

supporting protrusions disposed at both sidewalls of the dust-collecting chamber which support both sides of the filter mounted on the filter grill; and a plurality of ribs disposed around the grill in order to support an upper side and a lower side of the filter.

2. The filter supporting structure of claim 1, wherein the supporting protrusions have a curved side which contact with the dust bag.

3. The filter supporting structure of claim 1, wherein the supporting protrusions are cylindrical shaped.

4. The filter supporting structure of claim 3, wherein the supporting protrusions have a pressing member to press and firmly hold the filter against the filter grill.

5. The filter supporting structure of claim 1, wherein the ribs are formed higher than the width of the filter mounted the filter grill.

* * * * *